US011312098B2

(12) United States Patent
Perini

(10) Patent No.: US 11,312,098 B2
(45) Date of Patent: Apr. 26, 2022

(54) EQUIPMENT AND METHOD FOR THE PRODUCTION OF CARDBOARD TUBES

(71) Applicant: FUTURA S.P.A., Fraz. Guamo (IT)

(72) Inventor: Fabio Perini, Viareggio (IT)

(73) Assignee: FUTURA S.P.A., Capannori (IT)

( * ) Notice: Subject to any disclaimer, the term of this patent is extended or adjusted under 35 U.S.C. 154(b) by 248 days.

(21) Appl. No.: 15/114,629

(22) PCT Filed: Jan. 9, 2015

(86) PCT No.: PCT/IT2015/000001

§ 371 (c)(1),
(2) Date: Jul. 27, 2016

(87) PCT Pub. No.: WO2015/114672

PCT Pub. Date: Aug. 6, 2015

(65) Prior Publication Data

US 2016/0347021 A1 Dec. 1, 2016

(30) Foreign Application Priority Data

Jan. 29, 2014 (IT) ..... FI2014A000015

(51) Int. Cl.
*B31C 3/00* (2006.01)
*B31C 11/04* (2006.01)

(52) U.S. Cl.
CPC ..... *B31C 3/00* (2013.01); *B31C 11/04* (2013.01)

(58) Field of Classification Search
CPC .. B31C 3/00; B31C 11/04; B31B 3/00; B31B 11/00; B31B 11/02; B65H 2301/324; B65H 2301/3113
USPC ..... 493/269, 273, 276, 279, 288, 299, 300, 493/147; 226/108
See application file for complete search history.

(56) References Cited

U.S. PATENT DOCUMENTS 541,067 A * 6/1895 Clarke ..... B31C 1/00 493/304
610,344 A * 9/1898 Crowell ..... B65B 63/04 53/120

(Continued)

FOREIGN PATENT DOCUMENTS

WO 95/10399 A1 4/1995
WO 95/10400 A1 4/1995
WO WO2012101665 A1 * 8/2012 ..... B31C 3/00

*Primary Examiner* — Anna K Kinsaul
*Assistant Examiner* — Daniel Jeremy Leeds
(74) *Attorney, Agent, or Firm* — McGlew and Tuttle, P.C.

(57) ABSTRACT

Equipment for the production of cardboard tubes, comprising a tube-forming machine (1) provided with means for forming cardboard tubes with strips of cardboard (3) helically wound on a forming spindle (10), comprising a feeding unit (2) for feeding said cardboard strips, and comprising guide means (4) for guiding the cardboard strips (3) along a predetermined path (30, 31, 32) between the feeding unit (2) and the tube-forming machine (1), wherein in a final section (32) of said path the strips of cardboard (3) enter into the tube-forming machine (1). The guide means (4) are arranged and acting, along the said path, such that in said final section (32) of said path the cardboard strips (3) enter from the above or from the bottom into the tube-forming machine (1), so that said final section (32) is a descending or an ascending section of said path.

20 Claims, 4 Drawing Sheets

(56) References Cited

U.S. PATENT DOCUMENTS 634,191 A * 10/1899 Truyter ..... B31C 1/00 493/303
652,868 A * 7/1900 White ..... B31B 50/28 493/273
659,599 A * 10/1900 Bailey ..... B31C 1/00 493/276
755,494 A * 3/1904 Hornsteiner ..... B31C 1/00 493/303
858,387 A * 7/1907 Haefely ..... B31C 1/00 493/303
883,949 A * 4/1908 Gohy ..... B29C 66/135 493/287
968,241 A * 8/1910 Gohy ..... B29C 66/135 493/287
968,855 A * 8/1910 Kellner ..... B31C 1/00 493/303
1,201,812 A * 10/1916 Egli ..... A61F 2/64 12/142 W
1,211,514 A * 1/1917 Wilson ..... B31B 50/28 493/271
1,266,772 A * 5/1918 Crockett ..... B31C 3/00 493/272
1,431,946 A * 10/1922 Gudge ..... B31C 1/00 493/303
1,501,921 A * 7/1924 Scusa ..... B31C 1/00 493/277
1,582,079 A * 4/1926 Parsons ..... B29C 53/821 493/272
1,682,201 A * 8/1928 Thompson ..... A63D 15/00 285/125.1
1,795,668 A * 3/1931 Myers ..... B31C 1/00 118/262
1,831,062 A * 11/1931 Frederick ..... B31C 1/00 493/307
1,921,516 A * 8/1933 Frederick ..... B31C 1/00 138/157
1,990,481 A * 2/1935 Garling ..... B31C 3/00 493/278
2,008,717 A * 7/1935 Jarrier ..... B31C 1/00 156/184
2,398,876 A * 4/1946 Bailey ..... B29C 53/827 156/189
2,421,704 A * 6/1947 Kasten ..... B01D 29/111 210/497.1
2,489,503 A * 11/1949 Sampson ..... B31C 3/00 156/429
2,490,930 A * 12/1949 Thompson ..... B31B 70/00 493/274
2,841,202 A * 7/1958 Hirschy ..... D04H 3/07 156/426
2,934,130 A * 4/1960 George ..... B29C 53/50 156/463
2,951,322 A * 9/1960 William ..... B65B 9/073 493/269
3,038,832 A * 6/1962 Gustav ..... B29C 53/581 156/190
3,104,682 A * 9/1963 Schenk ..... A22C 13/0013 138/128
3,136,231 A * 6/1964 Hoyt ..... B31C 3/00 493/276
3,155,016 A * 11/1964 Pellicone ..... B31D 5/0091 242/535
3,401,073 A * 9/1968 Wood ..... B29C 63/10 156/187
3,813,026 A * 5/1974 Biancamaria ..... B31C 3/00 138/144
3,846,202 A * 11/1974 Clarke ..... B31C 3/00 138/129
4,473,368 A * 9/1984 Meyer ..... B31C 3/00 493/299
4,631,905 A * 12/1986 Maloney ..... B65B 9/023 493/196
4,645,553 A * 2/1987 Languillat ..... B31C 3/00 138/144
5,014,498 A * 5/1991 McMahon ..... B65B 9/20 226/108
5,106,356 A * 4/1992 Rhodes ..... B31C 3/00 493/271
6,027,438 A * 2/2000 Frazier ..... B65B 61/186 493/196
6,106,451 A * 8/2000 Andreasson ..... B29C 53/584 493/274
7,407,470 B2 8/2008 Perini
7,922,641 B2 * 4/2011 Maddaleni ..... B26D 1/60 493/288
8,337,375 B2 * 12/2012 Lee ..... B31C 3/00 493/276
8,554,354 B1 * 10/2013 Pagilla ..... B21B 37/68 226/15
8,707,662 B2 * 4/2014 Borsari ..... B29C 66/849 493/196
9,068,595 B2 * 6/2015 Gelli ..... F16C 39/063
9,352,526 B2 * 5/2016 Pettersson ..... B26D 1/18
9,393,753 B2 * 7/2016 Pettersson ..... B65H 23/28
2002/0035022 A1 * 3/2002 Fioretti ..... B29C 31/002 493/269
2004/0231959 A1 * 11/2004 Betti ..... B65G 17/46 198/347.1
2004/0248719 A1 * 12/2004 Yano ..... B65B 9/20 493/269
2005/0110208 A1 * 5/2005 Nilsson ..... B65H 29/12 271/184
2005/0245377 A1 * 11/2005 Perini ..... B31C 3/00 493/287
2005/0255981 A1 * 11/2005 Perini ..... B31C 3/00 493/276
2006/0288558 A1 * 12/2006 Gelli ..... B26D 1/58 29/429
2008/0009399 A1 * 1/2008 Gelli ..... B31C 3/00 493/272
2008/0153684 A1 * 6/2008 Perini ..... B31C 3/04 493/287
2010/0140311 A1 * 6/2010 Ebert ..... B65H 20/06 226/1
2011/0301007 A1 * 12/2011 Lamkemeyer ..... B31B 70/00 493/276
2011/0319242 A1 * 12/2011 Pettersson ..... B65H 16/00 493/126
2013/0331249 A1 * 12/2013 Chiocchetti ..... B31C 3/00 493/299
2015/0246500 A1 * 9/2015 Gambini ..... B31C 11/04 493/276
2017/0239907 A1 * 8/2017 Perini ..... B31C 3/00
2017/0305096 A1 * 10/2017 Dettori ..... B26D 1/60

* cited by examiner

EQUIPMENT AND METHOD FOR THE PRODUCTION OF CARDBOARD TUBES

The present invention relates to an equipment and a method for the production of cardboard tubes, in particular for the paper converting industry.

It is known that in paper converting plants a "tube-forming" machine produces rigid cardboard tubes (also called "core") on which the paper is wound to form a roll or "log" which is subsequently divided into more elements having a predefined length in order to obtain rolls of toilet paper, rolls of kitchen paper etc.

Each tube is obtained from strips of cardboard, fed by corresponding reels, which are helically wound on a metal spindle with horizontal axis and glued one on the other so as to form a self-supporting tubular structure. Generally, use is made of two or three strips of cardboard, depending on the desired thickness of the cores to be produced. It is also possible to produce tubular cores from a single cardboard strip and have customized cardboard feeding units. The cardboard strips are partially superimposed on each other and, by means of an eight-shaped belt they are wound on two guide rollers, are rolled around the mandrel and pushed forward, thus obtaining the tubular cardboard core that advances along the same spindle. Said belt wraps also around the spindle so as to engage the strips of cardboard.

Through a suitable cutting unit, the tubular cardboard core is cut to a predetermined length which substantially corresponds to the length of the logs to be produced by other machines that are normally called "rewinders".

The cardboard strips come from feeding units comprising reels from which the same cardboard strips are unwound, following a direct path between each feeding unit and the spindle of the tube-forming machine. Since the spindle is normally positioned at about one meter above the basement of the tube-forming machine, the space between the cardboard feeding units and the tube-forming machine is occupied by the cardboard strips. Therefore, it is not possible to position the cardboard feeding units and the tube-forming machine opposite to one another, otherwise the operators are not allowed to move freely between them, and the positioning of the cardboard feeding units and the tube-forming machines requires a wider space.

The main purpose of the present invention is to eliminate, or at least greatly reduce, the aforementioned drawbacks.

This result is achieved, according to the present invention, by adopting the idea of providing an apparatus and implementing a method having the characteristics indicated in the independent claims. Other features of the present invention are object of the dependent claims.

Thanks to the present invention, it is possible to have the cardboard feeding unit and the tube-forming machine facing one another without, however, preventing an operator to move freely between them and, therefore, obtaining the advantage of placing the cardboard feeding unit and the tube-forming machine according to a most efficient arrangement. In addition, the implementation of the present invention requires a very low expenditure in relation to the benefits.

These and other advantages and features of the present invention will be more understood by anyone skilled in the art from the following description and with the aid of the attached drawings, given as a practical exemplification of the invention, but not to be considered in a limiting sense, in which.

Figure 1:
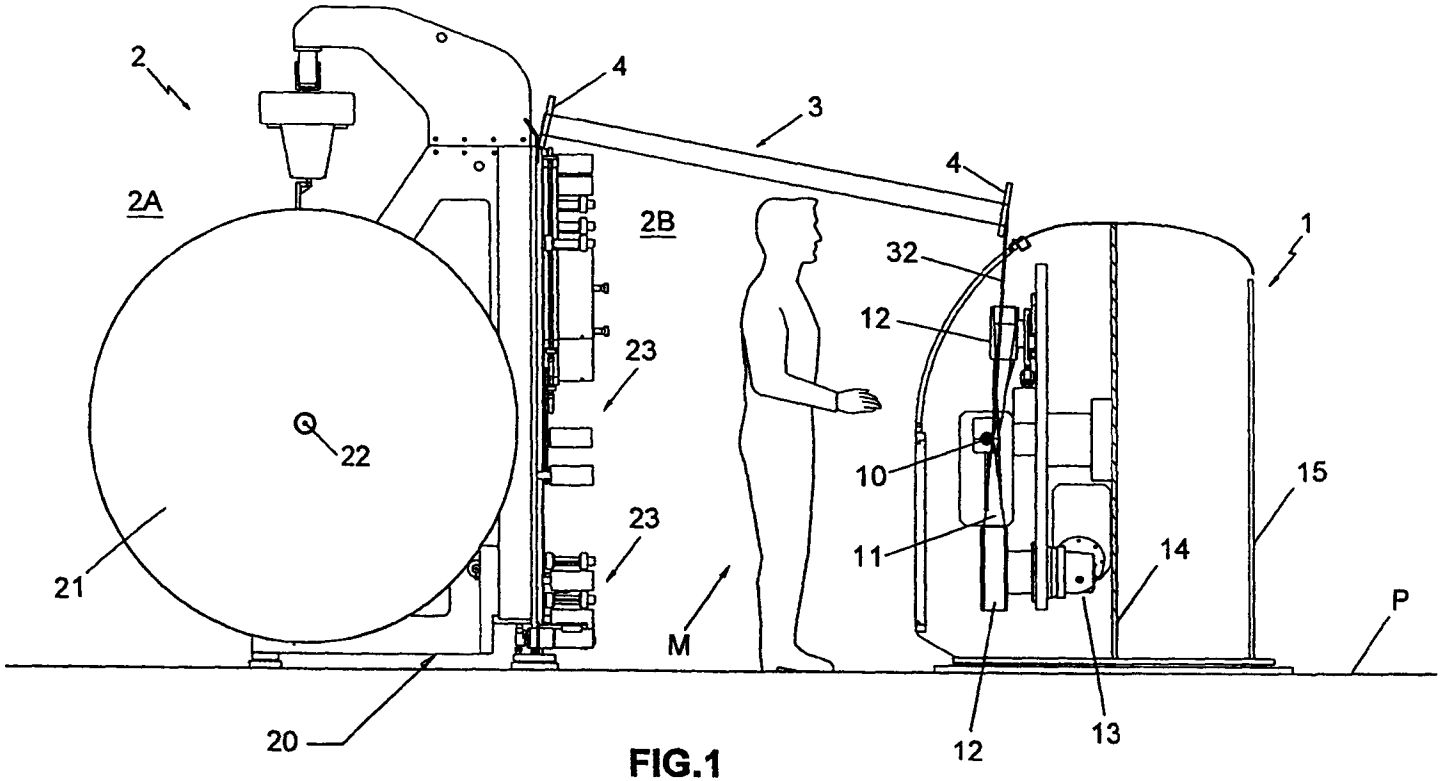
FIG. 1 is a schematic side view of an equipment according to the present invention.

Reduced to its basic structure and with reference to the attached drawings, the equipment according to the present invention comprises a tube-forming machine (1) and a feeding unit (2) that supplies the tube-forming machine with the cardboard required for forming the cardboard tubes. The tube-forming machine (1) and the feeding unit (2) are known per se. In particular, with reference to the example shown in the attached drawings, the tube (1) is of the type comprising a spindle (10) served by a belt (11) wound on two pulleys (12) so as to form a "8"-shaped figure. One of said pulleys is connected to a gear motor (13), while the other pulley is free to rotate about its own axis. The unit constituted by the gear motor (13), the pulleys (12) and the spindle (10) is supported by a structure (14) protected by a casing (15). The belt (11) drags the glued cardboard strips (3) coming from the supply unit (2) and wounds them on the spindle (10), making them simultaneously move parallel to the longitudinal axis of the spindle. A tube-forming machine of this type is described, for example, in WO 95/10400 and WO 95/10399.

The feeding unit (2) is of the type comprising a support structure (20), which, on one side (2A), supports one or more reels (21) with horizontal axis (22) from which the cardboard strips (3) are unwound and, on the other side (2B)supports a series of rollers for guiding and tensioning the cardboard strips (3) and a plurality of tanks containing liquid glue that is applied on a lower side of the same cardboard strips (3) dragged by the belt (1) as disclosed above. The structure (20) has a series of slits (25) through which the cardboard strips (3) of the reels (21) can pass from the side (2A) to the side (2B) of the structure (20). In practice, while advancing along a direction (D) parallel to the side (2B) of the structure (20), the strips of cardboard (3) receive a predetermined quantity of liquid glue on their lower side. A feeding unit so structured and functioning is described in U.S. Pat. No. 7,407,470.

Advantageously, according to the present invention, the tube-forming machine (1) and the feed unit (2) are provided with guide means adapted to force the cardboard strips (3 to enter the tube-forming machine (1) from the above. For example, the said guide means are constituted by rollers (4) respectively placed on the second side (2B) of the structure (20) and on top of the casing (15). In this way, the tube-forming machine (1) and the feed unit (2) can be placed one opposite the other (as shown in FIG. 2) and the space between the tube-forming machine (1) and the feed unit (2) is freely accessible, so there is a more rational arrangement of the machines and an operator (M) can move freely between them to operate both the machines without being forced to constantly move around them.

Figure 3:
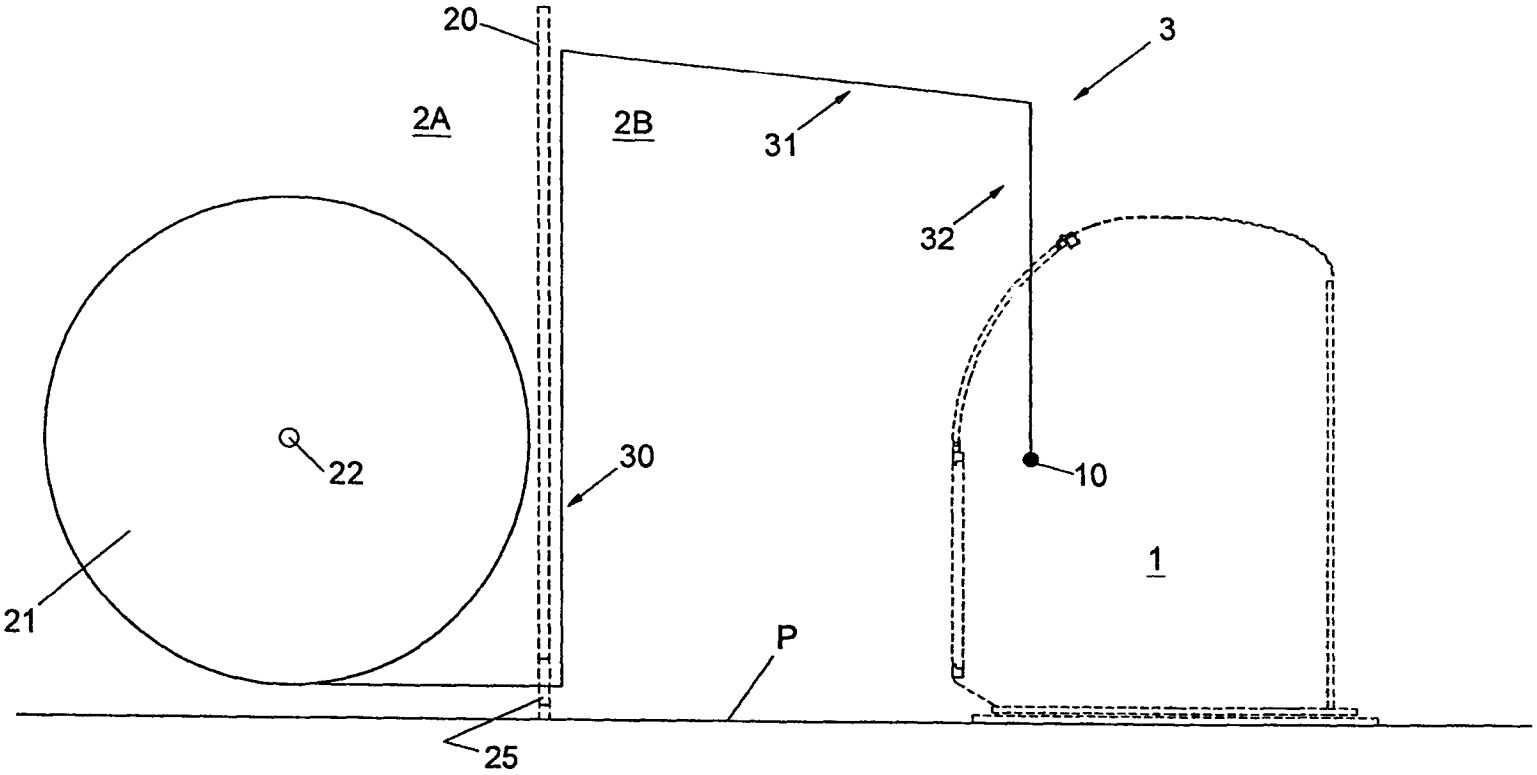
FIG. 3 is a scheme that shows the path followed by the cardboard strips.

In FIG. 3, a strip of cardboard (3) follows a path that has a first section (30) between a slot (25) of the structure (20) and a point at a predetermined height relative to the floor (P) on which rest the feed unit (2) and the tube-forming machine (1), a second section (31) overhanging the space between the feed unit (2) and the tube-forming machine (1), and a third section (32) which, from above, enters the tube-forming machine (1) from an upper opening of the casing (15) and reaches the spindle (10). For example, the said second section (31) is at a height greater than 1.70 m above the floor.

Figure 2:
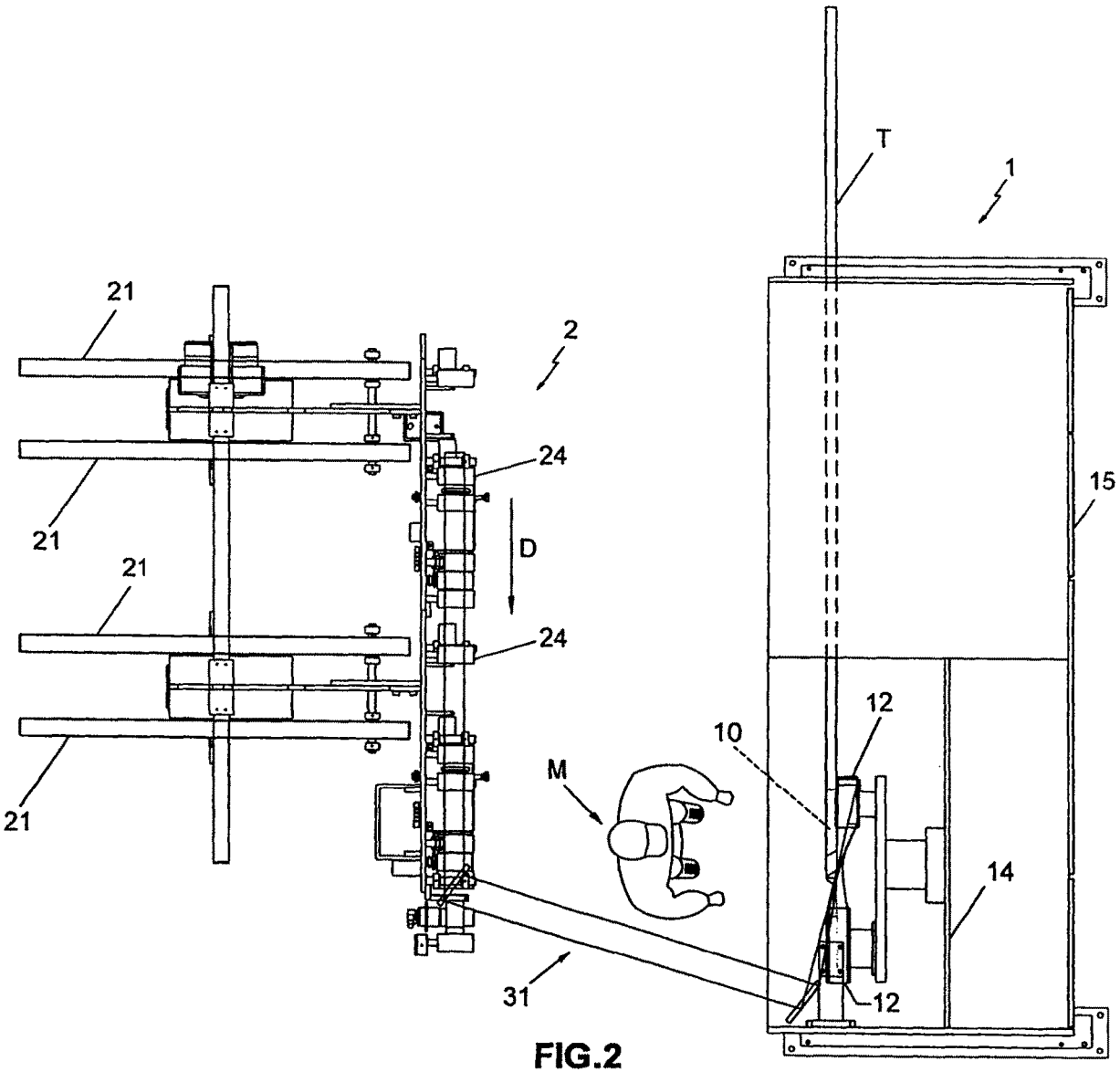
FIG. 2 is a schematic view from the above of the equipment shown in FIG. 1.

In FIG. 2 the cardboard tube that comes out of the tube-forming machine (1) is denoted by the reference "T".

FIG. 2 shows, in particular, the tube-forming machine (1) and the feed unit (2) with the spindle (10) oriented parallel to the axis (22) that supports the reels (21), so that the tube-forming machine (1) and the feed unit (2) are positioned perfectly opposite to one another.

In accordance with the present invention, a method for the production of cardboard tubes, comprises the use of a tube-forming machine (1) provided with means for forming cardboard tubes with strips of cardboard (3) wrapped helically about a forming spindle (10), comprises the use of a unit (2) for feeding said cardboard strips, and comprises the use of guide means (4) for guiding the cardboard strips (3) along a predetermined path (30, 31, 32) between the feed unit (2) and the tube-forming machine (1), wherein in a final leg (32) of said path the strips of cardboard (3) enter the tube-forming machine (1), and in said final leg (32) the cardboard strips (3) enter from the above into the tube-forming machine (1), whereby said final leg (32) is a descending leg of said path.

An intermediate leg (31) of said path (30, 31, 32) is above a space between the tube-forming machine (1) and the feed unit (2).

A solution equally advantageous according to the present invention implies a different positioning of the intermediate leg (31) which, rather than above the space between the tube-forming machine (1) and the feed unit (2), is at a height less than a predetermined value (for example, at a height less than 30 cm) above the floor. In this case, the final leg (32) is an ascending part of said path. To avoid that the operator is obstructed by said intermediate leg, in this case it can be arranged a step that allows the same operator to pass over the intermediate leg when this is necessary. Or, in this case, said intermediate leg (31) can run in a box-shaped guide provided in the floor.

In each of the two cases described above, that is, both in the case that the intermediate leg (31) of said path is above the space between the tube-forming machine (1) and the feed unit (2), and in the case that said intermediate leg (31) is at a level sufficiently low to allow the operator to move freely between the tube-forming machine (1) and the feed unit (2), the desired result is obtained.

Figure 4:
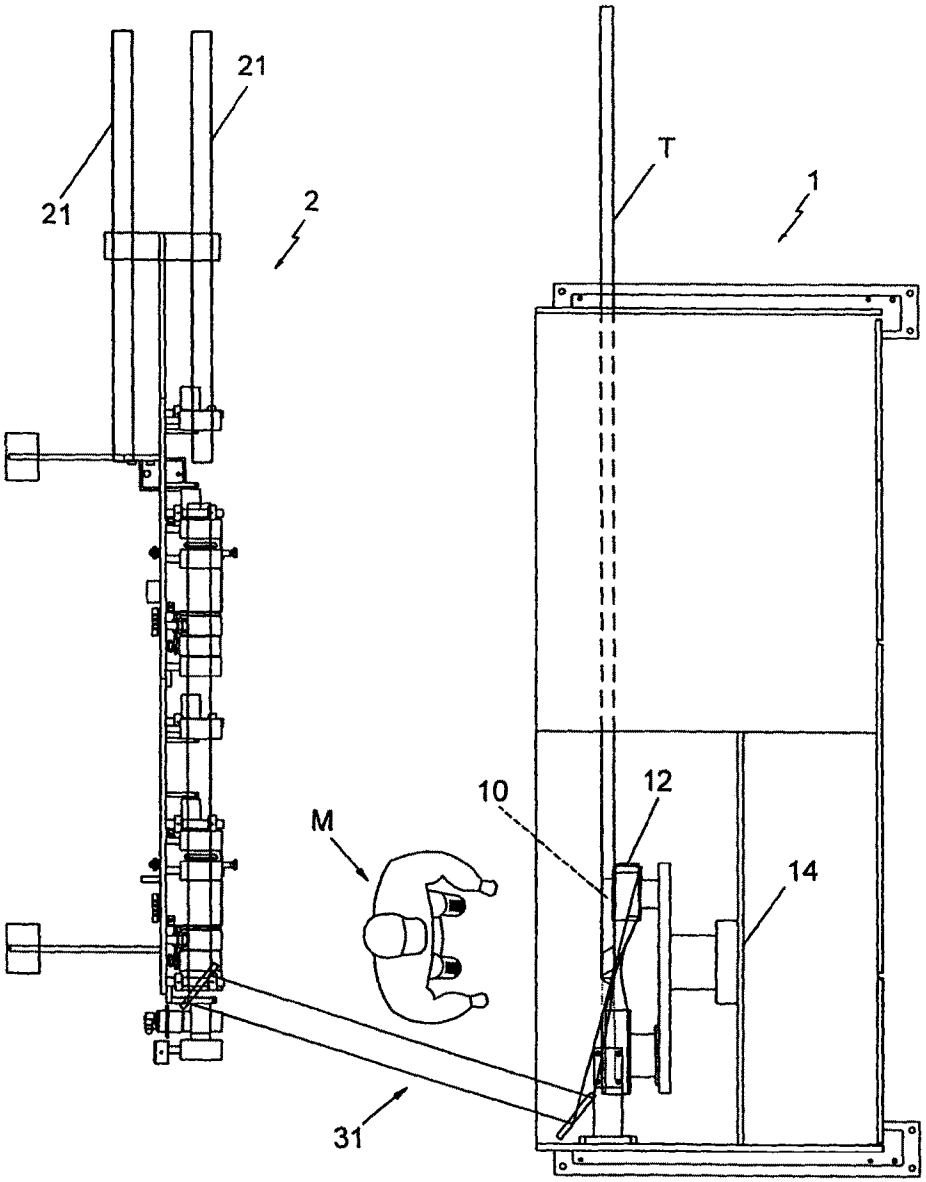
FIG. 4 shows another arrangement of the reels by which the cardboard strips are supplied.

According to the example shown in FIG. 4, the reels (21) feeding the strips of cardboard (3) are positioned with their axes oriented perpendicular to the axis of the spindle (10), so that the production system as a whole is further compacted.

In practice the details of execution may vary in any equivalent way as for what concerns the individual elements described and illustrated, and their mutual arrangement, without departing from the scope of the adopted solution and thus remaining within the limits of the protection granted to the present patent.

The invention claimed is:

1. Equipment for producing cardboard tubes, the equipment comprising:

a tube-forming machine comprising a means for forming cardboard tubes with strips of cardboard helically wound on a forming spindle;

a feeding unit for feeding said cardboard strips; and a guide means for guiding the cardboard strips along a predetermined path between the feeding unit and the tube-forming machine, wherein in a final section of said predetermined path the strips of cardboard enter into the tube-forming machine, said guide means being arranged and acting, along the predetermined path, such that in said final section of said predetermined path the cardboard strips enter from above the tube-forming machine or from a bottom of the tube-forming machine into the tube-forming machine, so that said final section is a descending or an ascending section of said predetermined path, the tube-forming machine producing cardboard tubes being adapted to collect paper thereon to form paper logs from which paper rolls are obtained, said path further comprising a first section exiting from said feeding unit and an intermediate section comprised between said first section and said final section of said path, wherein a free space is defined between said feeding unit and said tube-forming machine, said free space being entirely free of strips, said intermediate part of said path is above or below said free space, said cardboard strips being fed each by a respective bobbin from which said cardboard strips are drawn, said cardboard strips being configured to be helically wound on said forming spindle of said tube-forming machine, wherein no structure is provided in said free space between said feeding unit and said tube-forming machine and no strips of cardboard pass through said free space.

2. The equipment according to claim 1, wherein said tube-forming machine comprises an outer casing and said feeding unit comprises a supporting structure supporting one or more bobbins from which the cardboard strips are drawn, said means for guiding the strips of cardboard comprising a plurality of rollers arranged at a predetermined height from a surface on which the tube-forming machine and the feeding unit rest.

3. The equipment according to claim 1, wherein an intermediate section of said predetermined path is above a space comprised between the tube-forming machine and the feeding unit or said intermediate section is at a height lower than a predetermined value with respect to a surface on which the tube-forming machine and the feeding unit rest.

4. The equipment according to claim 1, wherein the cardboard strips are drawn from corresponding bobbins mounted on respective shafts supported by a fixed structure of the feeding unit, said shafts being parallel or orthogonal to said forming spindle.

5. A method for producing cardboard tubes, the method comprising:

using a tube-forming machine comprising a means for forming cardboard tubes with strips of cardboard helically wound on a forming spindle;

using a feeding unit for feeding said cardboard strips; and using a guide means for guiding the cardboard strips along a predetermined path between the feeding unit and the tube-forming machine, wherein in a final section of said predetermined path the strips of cardboard enter into the tube-forming machine, wherein in said final section of said predetermined path the cardboard strips enter from above the tube-forming machine or from a bottom of the tube-forming machine into the tube-forming machine, so that said final section is a descending or an ascending section of said predetermined path, the tube-forming machine producing cardboard tubes being adapted to collect paper thereon to form paper logs from which paper rolls are obtained, said path further comprising a first section exiting from said feeding unit and an intermediate section comprised between said first section and said final section of said path, wherein a free space is defined between said feeding unit and said tube-forming machine, said free space being entirely free of strips, said intermediate part of said path being above or below said free space, said cardboard strips being fed each by a respective bobbin from which the cardboard strips are drawn, the cardboard strips being configured to be helically wound on the forming spindle of the tube-forming machine, wherein no structure is provided in said free space between said feeding unit and said tube-forming machine and no strips of cardboard pass through said free space.

6. The method according to claim 5, wherein an intermediate section of said predetermined path is above a space comprised between the tube-forming machine and the feeding unit.

7. The method according to claim 5, wherein an intermediate section of said predetermined path is at a height lower than a predetermined value with respect to a surface on which the tube-forming machine and the feeding unit rest.

8. Equipment for producing cardboard tubes, the equipment comprising:

a tube-forming machine producing cardboard tubes with strips of cardboard helically wound on a forming spindle;

a feeding unit for feeding said cardboard strips, the feeding unit comprising a reel;

a support structure supporting the feeding unit, the support structure comprising a support structure portion extending from at least a first support structure portion position to a second support structure portion position, the first support structure portion position being located adjacent to the reel, the second support structure portion position being located at a height greater than a height of the reel; and a guide structure defining a cardboard strip delivery path extending from at least a first position to at least a second position, the first position being located directly adjacent to the second support structure position, the second position being located above the tube-forming machine, wherein at least a portion of the cardboard strip delivery path is provided between the feeding unit and the tube-forming machine, the portion of the cardboard strip delivery path spanning a space between the feeding unit and the tube-forming machine, the portion of the cardboard strip delivery path being located above the space, wherein no strips of cardboard are located in the space below the portion of the cardboard strip delivery path, each and every part of the portion of the cardboard strip delivery path having a height greater than a height of the tube-forming machine, wherein in a final section of the cardboard strip delivery path the strips of cardboard enter into the tube-forming machine from the second position located above the tube-forming machine, the cardboard strips being fed each by a respective bobbin from which the cardboard strips are drawn, the cardboard strips being configured to be helically wound on the forming spindle of the tube-forming machine, wherein no structure is provided in the free space between the feeding unit and the tube-forming machine and no strips of cardboard pass through the free space.

9. The equipment according to claim 8, wherein the final section is a descending or an ascending section of the cardboard strip delivery path, the tube-forming machine producing cardboard tubes being adapted to collect paper thereon to form paper logs from which paper rolls are obtained.

10. The equipment according to claim 9, wherein the tube-forming machine comprises an outer casing and the feeding unit comprises a supporting structure supporting one or more bobbins from which the cardboard strips are drawn, the guide structure comprising a plurality of rollers arranged at a predetermined height from a surface on which the tube-forming machine and the feeding unit rest.

11. The equipment according to claim 9, wherein an intermediate section of said predetermined path is above the space between the tube-forming machine and the feeding unit, at least a portion of the space being free of the tube-forming machine and the feeding unit.

12. The equipment according to claim 9, wherein the cardboard strips are drawn from corresponding bobbins mounted on respective shafts supported by a fixed structure of the feeding unit, the shafts being parallel or orthogonal to the forming spindle.

13. The equipment according to claim 10, wherein the first position is located above the bobbins and the first position is located adjacent to an uppermost portion of the supporting structure.

14. The equipment according to claim 9, wherein the tube-forming machine comprises an outer casing, the second position being located at a position above an upper portion of the outer casing.

15. The equipment according to claim 9, wherein a height of the first position is greater than a height of the second position.

16. The equipment according to claim 9, wherein the height of the portion of the cardboard strip delivery path comprises a cardboard strip delivery path height, the cardboard strip delivery path height being greater than a height of the second position.

17. The equipment according to claim 16, wherein the tube-forming machine comprises an outer casing, wherein an uppermost portion of the outer casing has an outer casing height, the cardboard strip delivery path height being greater than the outer casing height.

18. The equipment according to claim 16, wherein the portion of the cardboard strip delivery path is inclined between the first position and the second position.

19. The equipment according to claim 9, wherein the height of the portion of the cardboard strip delivery path decreases from the first position to the second position.

20. The equipment according to claim 9, wherein the portion of the cardboard strip delivery path has a downward slope from said first position to said second position.

* * * * *